US007489895B2

(12) United States Patent
Tani

(10) Patent No.: US 7,489,895 B2
(45) Date of Patent: Feb. 10, 2009

(54) IMAGE-RECORDING PROCESS INCLUDING CURL-CONTROLLING AND COOLING AND IMAGE-RECORDING APPARATUS

(75) Inventor: Yoshio Tani, Shizuoka (JP)

(73) Assignee: Fuji Photo Film Co., Ltd., Minami-Ashigara-Shi (JP)

( * ) Notice: Subject to any disclaimer, the term of this patent is extended or adjusted under 35 U.S.C. 154(b) by 465 days.

(21) Appl. No.: 11/205,326

(22) Filed: Aug. 17, 2005

(65) Prior Publication Data

US 2006/0040093 A1 Feb. 23, 2006

(30) Foreign Application Priority Data

Aug. 19, 2004 (JP) ..... 2004-240083

(51) Int. Cl.
*G03G 15/20* (2006.01)
*G03G 15/00* (2006.01)

(52) U.S. Cl. ..... 399/329; 399/406

(58) Field of Classification Search ..... 399/406, 399/322, 68, 69, 329
See application file for complete search history.

(56) References Cited

U.S. PATENT DOCUMENTS

| | | | | |
|---|---|---|---|---|
| 3,981,085 | A * | 9/1976 | Franko | |
| 4,963,943 | A * | 10/1990 | Tamary | |
| 5,118,589 | A * | 6/1992 | Aslam et al. | |
| 5,119,142 | A * | 6/1992 | Swapceinski et al. | |
| 6,777,101 | B2 * | 8/2004 | Kegasawa et al. | |
| 6,865,363 | B2 * | 3/2005 | Hachisuka et al. | 399/329 |
| 6,871,040 | B2 * | 3/2005 | Tani et al. | 399/329 |
| 6,928,257 | B2 * | 8/2005 | Ogiso et al. | 399/329 |
| 6,965,750 | B2 * | 11/2005 | Muratani | 399/406 |
| 7,244,690 | B2 * | 7/2007 | Omata et al. | |
| 2007/0110490 | A1 * | 5/2007 | Tateishi | 399/406 |
| 2007/0183822 | A1 * | 8/2007 | Kitazawa et al. | 399/329 |

FOREIGN PATENT DOCUMENTS

| | | | |
|---|---|---|---|
| JP | 4-501925 | | 4/1992 |
| JP | 04260065 | A * | 9/1992 |
| JP | 04299369 | A * | 10/1992 |
| JP | 5-72926 | | 3/1993 |
| JP | 06016310 | A * | 1/1994 |
| JP | 09171311 | A * | 6/1997 |
| JP | 2003066744 | A * | 3/2003 |
| JP | 2003137467 | A * | 5/2003 |
| JP | 2004-4596 | | 1/2004 |
| JP | 2005089079 | A * | 4/2005 |
| WO | WO 91/03771 | A1 | 3/1991 |

* cited by examiner

*Primary Examiner*—Susan S Lee
(74) *Attorney, Agent, or Firm*—Kratz, Quintos & Hanson, LLP

(57) ABSTRACT

It is an object of the present invention to provide an image-recording process and an image-recording apparatus, even at high density image and high speed image output, capable of suppressing the occurrence of curl in the final image sheet, and controlling and giving the desired direction and size of the curl. For this purpose, an image-recording process includes recording an image on an image-recording material which includes a thermoplastic resin contained layer on a support, heating the image-recording material to a temperature higher than a glass transition temperature of thermoplastic resin in the thermoplastic resin contained layer, controlling the curl by contacting a curl controlling member with at least a part of the image-recording material, and cooling the image-recording material to a temperature below the glass transition temperature of the thermoplastic resin.

24 Claims, 6 Drawing Sheets

IMAGE-RECORDING PROCESS INCLUDING CURL-CONTROLLING AND COOLING AND IMAGE-RECORDING APPARATUS

BACKGROUND OF THE INVENTION

1. Field of the Invention

The present invention relates to an image-recording process and an image-recording apparatus capable of giving curls of desired direction and size at desired position of various image-recording materials.

2. Description of the Related Art

A toner used for electrophotographic recording is melted and flattened so as to be hardened and fixed on a surface of an image-receiving sheet by heat and pressure fixing process. As a result, a thermoplastic resin is used as a binder of the toner. Also, an image-receiving layer which comprises the thermoplastic resin is disposed on a surface of a support for the image-receiving sheet with an object to increase the fixing property of the toner. The thermoplastic resin of a toner and image-receiving layer like this, normally, together with plastic deformability, has elastic deformability generally. The image-receiving sheet with which the toner is transferred on the image-receiving layer is heated and pressurized, melt deformed and flattened, and fixed on the surface of the image-receiving layer by a fixing process comprising heating and pressurizing roller. After that, when the fixing process is passed through and stress is released, on the toner and image-receiving layer, during the period until they are cooled, elastic recovered and the action of returning from the flattened state to the original is worked, as a result, contractive force is generated on the surface of the image-receiving layer and the image-receiving sheet curls so that the surface of the image-receiving layer becomes a concave shape. This especially is remarkable when the amount of the toner is plenty at high density image, and when the thickness of the receiving layer of high image quality use is thick.

The curl phenomenon is common not only in electrophotographic material, but also in recording method by heating in which the thermoplastic resin is used in a color material and an image-receiving layer. For example, in transfer material and sublimation-transfer materials provided with donor film and a receiving layer, and a heat-sensitive material, the same problem is occurred.

Also, image-receiving sheet is used a lot in roll-feed paper which is advantageous in high speediness and cost, as a result, the winding habit remains and the remaining curl also remains on the sheet after image fixing, especially, in the case of seeking high image quality and high durability like photographic print, as image-receiving layer comprising the thermoplastic resin is disposed, or a support coated or laminated with the thermoplastic resin on the raw paper is used, there is a problem that furthermore, the winding habit remains easily and the winding habit correction is difficult.

The curl problem caused by the winding habit in the above-mentioned rolled form is common and true in an image-recording material comprising a thermoplastic resin in a color material and an image-receiving layer, namely, an electrophotographic material, a heat-transfer material, a sublimation-transfer material, a heat-sensitive material comprising donor film and image-receiving layer, ink-jet material comprising ink image-receiving layer, and the like also has similar curl occurring problem.

As a method of suppressing the curl occurring because of various factors like this, for example, Japanese Patent Application Laid-Open (JP-A) No. 04-501925 and Japanese Patent Application Laid-Open (JP-A) No. 2004-4596 propose an improvement of the image-receiving sheet. However, as both proposals receive the influence of donor and fixing condition, there is a problem of little effect to the curl in the final image output sheet.

Also, a fixing apparatus comprising belt fixing step, is proposed in Japanese Patent Application Laid-Open (JP-A) No. 05-72926. According to this proposal, though there is a constant effect to increase glossiness and to prevent offset, the controlling of the direction and size of the curl is impossible, and when the image output speed becomes high speed, there is a problem that the curl correction becomes insufficient.

Moreover, not only merely suppressing the occurrence of the curl, like photographic print, there is a case also where the surface of an image prefers to become more or less a concave shape, it is also desired that the controlling of the direction and size of the curl satisfies the needs of the user.

SUMMARY OF THE INVENTION

It is an object of the present invention to provide an image-recording process and an image-recording apparatus, even at high density image and high speed image output, capable of suppressing the occurrence of curl in the final image sheet, and controlling and giving the desired direction and size of the curl.

The image-recording process of the present invention comprises recording an image on an image-recording material comprising at least a thermoplastic resin contained layer on a support, heating the image-recording material to a temperature higher than a glass transition temperature of a thermoplastic resin in the thermoplastic resin contained layer, controlling the a curl by contacting a curl controlling member with at least a part of the image-recording material, and cooling the image-recording material to a temperature below a glass transition temperature of the thermoplastic resin.

According to the image-recording process of the present invention, even at high density image and high speed image output, it can be achieved to suppress the occurrence of curl in the final image sheet, and control and give effectively the desired direction and size of the curl.

The image-recording apparatus of the present invention comprises a support and, an image-recording unit recording an image on the image-recording material comprising the thermoplastic resin contained layer on the support, a heating unit heating the image-recording material to a temperature higher than a glass transition temperature of the thermoplastic resin in the thermoplastic resin contained layer, a curl controlling unit controlling the curl by contacting a curl controlling member with at least a part of the image-recording material, and a cooling unit cooling the image-recording material to a temperature below the glass transition temperature of the thermoplastic resin.

The image-recording apparatus of the present invention, even at high density image and high speed image output, capable of suppressing the occurrence of curl in the final image sheet, and controlling and giving the desired direction and size of the curl.

Figure 1:
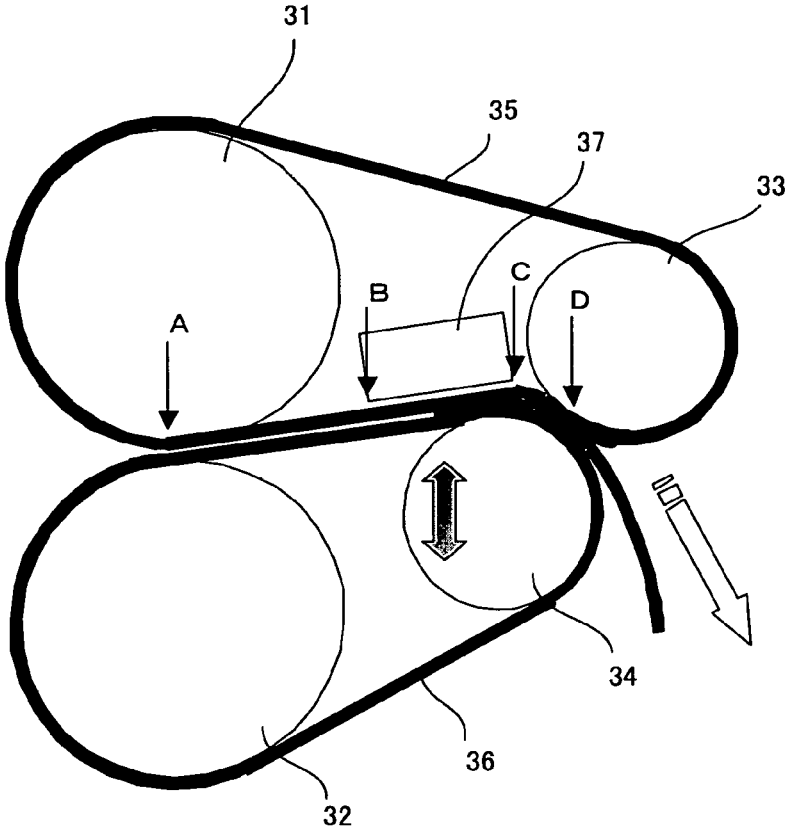
FIG. 1 is a schematic diagram showing an example of a belt curl controlling device of the present invention.

DESCRIPTION OF THE PREFERRED EMBODIMENTS (Image-recording Process and Image-recording Apparatus)

The image-recording apparatus of the present invention comprises an image-recording unit, a heating unit, a cooling unit, a curl controlling unit, and further comprises other units suitably selected, for example, roll-cutting unit, roll paper feeding unit, and controlling unit if necessary.

The image-recording process of the present invention comprises image-recording, heating, cooling, curl controlling, and further comprises other units suitably selected, for example, roll-cutting, roll paper feeding, and controlling if necessary.

The image-recording process of the present invention can be carried out suitably according to the image-recording apparatus of the present invention, and the image-recording can be carried out according to the image-recording unit, and the curl controlling can be carried out according to the curl controlling unit, and the heating can be carried out according to the heating unit, and the cooling can be carried out according to the cooling unit, and the above-mentioned others can be carried out according to the above-mentioned other units.

The curl controlling is preferably carried out between the heating and the cooling.

Image-recording and Image-recording Unit

The image-recording records an image on the image-recording material comprising at least a thermoplastic resin contained layer on the support, and is performed according to the image-recording unit.

<Support>

The support is not limited and may be suitably selected according to the purpose, for example, a support provided with polyolefin resin layer on at least one surface of the raw paper is preferable, especially a support provided with polyolefin resin layer on both surfaces of the raw paper is more preferable, and further comprises other layers if necessary.

<Raw Paper>

The raw paper is not limited and may be suitably selected according to the purpose, specifically, a fine paper, for example, the paper described in "The Basic of Photographic Engineering-Silver Halide Photograph Volume", pp. 223 to 224, edited by The Society of Photographic Science and Technology of Japan, Corona Corporation issued in 1979 is suitable.

The raw paper, used for a support is not limited as long as it is a well-known material and may be suitably selected from all types of materials according to the purpose, for example, natural pulp of conifer and broadleaf tree, and a mixture of the natural pulp and synthetic pulp, are suitable.

The pulp that can be used as the material of the raw paper is desirable to be bleached broadleaf tree kraft pulp (LBKP), but bleached conifer kraft pulp (NBKP) and broadleaf tree sulfite pulp (LBSP) may also be used because they enhance the surface smoothness, rigidity and dimension stability (curl property) of the raw paper at the same time with good balance and to sufficient level.

As the beating of the pulp, a beater and a refiner may be used.

The Canada Standard Filtered Water Degree of the pulp is preferably 200 ml to 440 ml C.S.F., and more preferably 250 ml to 380 ml C.S.F. because in paper making, the shrinkage of the paper can be controlled.

Various additives, for example, fillers, dry paper reinforcers, sizing agents, wet paper reinforcers, fixing agents, pH regulators or other agents, or the like may be added, if necessary, to the pulp slurry (hereafter, may be referred to as pulp paper material) which is obtained after beating the pulp.

Examples of the fillers include calcium carbonate, clay, kaolin, white clay, talc, titanium oxide, diatomaceous earth, barium sulfate, aluminum hydroxide, magnesium hydroxide, and the like.

Examples of the dry paper reinforcers include cationic starch, cationic polyacrylamide, anionic polyacrylamide, amphoteric polyacrylamide, carboxy-modified polyvinyl alcohol, and the like.

Examples of the sizing agents include higher fatty acid salt; rosin derivatives such as rosin, maleic rosin or the like; paraffin wax, alkyl ketene dimer, alkenyl succinic anhydride (ASA); higher fatty acid such as epoxidized fatty amide, and the like.

Examples of the wet paper reinforcers include polyamine polyamide epichlorohydrin, melamine resin, urea resin, epoxy polyamide resin, and the like.

Examples of the fixing agents include polyvalent metal salt such as aluminum sulfate, aluminum chloride, or the like; cationic polymers such as cationic starch, or the like.

Examples of the pH regulators include caustic soda, sodium carbonate, and the like.

Examples of other agents include defoaming agents, dyes, slime control agents, fluorescent whitening agents, and the like.

Further, flexibilizer may also be added if necessary. The flexibilizer, for example, can be the one described in "New Paper Processing Handbook", pp. 554 to 555, edited by Kamiyaku Time Corporation and issued in 1980.

These various additives may be used alone or in combination. Also, the amount of these various additives to be added to the pulp paper material are not limited and may be suitably selected according to the purpose, generally, preferably 0.1% by mass to 1.0% by mass.

For the pulp slurry, further, according to necessity, pulp paper material comprising the above-mentioned various additives is paper made using paper machine such as hand paper machine, wire paper machine, cylinder paper machine, twin wire machine and combination machine, and after that dried and raw paper is made. Also, according to desire, the treatment for sizing a surface can be carried out any one of before and after the drying.

The treatment solution used for sizing a surface is not limited and may be suitably selected according to the purpose, for example, may comprise water soluble polymer compound, water-resistant substance, pigment, dye and fluorescent whitening agent.

The water soluble polymer compound, for example, may be cationized starch, polyvinyl alcohol, carboxy-modified polyvinyl alcohol, carboxymethyl cellulose, hydroxyethyl cellulose, cellulose sulfate, gelatin, casein, polyacrylic sodium, styrene-maleic anhydride copolymer sodium salt and polystyrene sulfonic acid sodium.

The water-resistant substance, for example, mat be latex emulsion such as styrene-butadiene copolymer, ethylene-vinyl acetate copolymer, polyethylene and vinylidene chloride copolymer, and polyamide-polyamine-epichlorohydrin.

The pigment, for example, may be calcium carbonate, clay, kaolin, talc, barium sulfate and titanium oxide.

For the raw paper, in an attempt to improve the rigidity and dimensional stability (curl properties), the ratio ($E_a/E_b$) of vertical direction Young's modulus ($E_a$) and horizontal direction Young's modulus $E_b$ is preferably in the range of 1.5 to 2.0. In the range of the value of $E_a/E_b$ is less than 1.5, or more than 2.0, it is not preferable because the rigidity and the curl properties of the recording material is likely to be inferior, and may interfere with paper during the conveying operation.

Generally, it is understood that the "stiffness" of the paper differs depending on the various manners in which the paper is beaten, and after beating, the elastic force (rate) of the paper produced by paper making can be used as an important factor to show the degree of "stiffness" of the paper. By making use of the relation of the dynamic elastic modulus and density showing the properties of viscoelastic material of the paper, and using the ultrasonic vibrating element to this, and measuring the sound velocity transmitting all over the paper, the elastic modulus of the paper can be found according to the following equation in particular.

$$E=\rho c^2(1-n^2)$$

Provided that, in the above equation, "E" represents dynamic elastic modulus. "P" represents density. "c" represents sound velocity all over the paper. "n" represents Poisson's ratio.

Also, in the case of ordinary paper, as n=0.2 approximately, there is no great difference even by calculating with the following equation, and can be calculated.

$$E=\rho c^2$$

Namely, if the density and sound velocity of the paper can be measured, elastic modulus can be easily found. In the above equation, when measuring sound velocity, all types of well-known apparatuses such as Sonic Tester-SST-110 (manufactured by Nomura Shoji Co., Ltd.) may be used.

For the raw paper, in order to give desired center line average roughness on the surface, for example, as reported in Japanese Patent Application Laid-Open (JP-A) No. 58-68037, it is preferable to use pulp fiber of fiber length distribution (for example the total of 24 mesh screen residue and 42 mesh screen residue, for example, is 20% by mass to 45% by mass, and 24 mesh screen residue is 5% by mass or less. Also, the center line average roughness can be adjusted by adding heating and pressuring to a surface of the raw paper, with a machine calender and super calender, and the like.

The thickness of the raw paper is not limited and may be suitably selected according to the purpose, generally, preferably 30 μm to 500 μm, more preferably 50 μm to 300 μm, and still more preferably 100 μm to 250 μm. The basic weight of the raw paper is not limited and may be suitably selected according to the purpose, for example, preferably 50 g/m$^2$ to 250 g/m$^2$, and more preferably 10 g/m$^2$ to 200 g/m$^2$.

Polyolefin Resin Layer

Polyolefin resin layer comprises at least polyolefin and further comprises other components if necessary.

The polyolefin, generally, is often formed using low density polyethylene, however, in order to increase the heat resisting property of the support, it is preferable to use polypropylene, a blend of polypropylene and polyethylene, high density polyethylene, and a blend of high density polyethylene and low density polyethylene. From the point of cost and laminated properties, using the blend of high density polyethylene and low density polyethylene is the most preferable in particular.

The high density polyethylene and the low density polyethylene is preferably blend ratio (mass ratio) of 1/9 to 9/1, more preferably 2/8 to 8/2, and still more preferably 3/7 to 7/3.

When forming polyolefin resin layer on both sides of the support, the back surface of the support, which is the opposite surface of the toner image-receiving layer being disposed, for example, it is preferable to form using high density polyethylene, or a blend of high density polyethylene and low density polyethylene.

The polyethylene is not limited and may be suitably selected according to the purpose, however, for any one of high density polyethylene and low density polyethylene, the melt index is preferably 1.0 g/10 min to 40 g/10 min.

These sheets or films may be applied a treatment so as to take a reflectivity against white color. Examples of such treatment include compounding a pigment such as titanium oxide or the like into the sheets or films.

The thickness of the polyolefin resin layer is preferably 10 μm to 50 μm, and more preferably 15 μm to 40 μm. When the thickness is less than 10 μm, shape forming becomes difficult, and when it is more than 50 μm, the rigidity of the support becomes stronger.

Also, the thickness of the support is not limited and may be suitably selected according to the purpose, however, it is preferably 25 μm to 300 μm, more preferably 50 μm to 260 μm, and still more preferably 75 μm to 220 μm.

<Thermoplastic Resin Contained Layer>

The thermoplastic resin contained layer is not limited and may be suitably selected according to the purpose as long as it comprises at least a thermoplastic resin, for example, preferably at least any one selected from an image-receiving layer, a color material layer, an intermediate layer, a support, a backing layer, and a combination thereof, and preferably a multiple image layer comprising a image-receiving layer and a color material layer in particular.

For the thermoplastic resin, the glass transition temperature (Tg) is preferably 40° C. to 100° C., and more preferably 50° C. to 90° C.

When the glass transition temperature is less than 40° C., in the case of image-recording materials being stored in piles, the front and the back of the image-recording materials tend to adhere easily and especially remarkably under high temperature and high humidity. When it is more than 100° C., for example, in electrophotographic material the toner is embedded less at fixing, and irregularity occurs and image quality declines.

The thermoplastic resin is not limited and may be suitably selected according to the purpose as long as the glass transition temperature is 40° C. to 100° C., for example, can be (1) polystyrene resin, (2) acrylic resin, (3) poly vinyl acetate or its derivatives, (4) polyamide resin, (5) polyester resin, (6) polycarbonate resin, (7) polyether resin (or acetal resin), and (8) other resins. These thermoplastic resins may be used alone or in combination.

The (1) polystyrene resin, for example, may be polystyrene resin, styrene-isobutylene copolymer, acrylonitrile-styrene copolymer (AS resin), acrylonitrile-butadiene-styrene copolymer (ABS resin), and polystyrene-maleic anhydride resin.

The (2) acrylic resin, for example, may be polyacrylic acid or its esters, polymethacrylic acid or its esters, polyacrylonitrile, and polyacrylamide. The polyacrylic acid esters and polymethacrylic acid esters differ greatly in properties according to the type of ester group. Also, they may be copolymer with other monomers (for example, acrylic acid, methacrylic acid, styrene, and vinyl acetate). The polyacrylonitrile is often used as a copolymer of the above-mentioned AS resin and ABS resin rather than as a polymer.

The (3) poly vinyl acetate or its derivatives, for example, may be poly vinyl acetate, polyvinyl alcohol obtained by saponifying poly vinyl acetate, and polyvinyl acetal resin obtained from reacting polyvinyl alcohol with aldehyde (for example, formaldehyde, acetaldehyde, and butyraldehyde).

The (4) polyamide resin is a polycondensation products of diamine and dihydric acid, and may be nylon 6 and nylon 66.

The (5) polyester resin is a polycondensation products of alcohol and acid, and differs greatly in properties depending on each combination, and may be general use resin such as polyethylene terephthalate and polybutylene terephthalate from aromatic dihydric acid and dihydric alcohol.

The (6) polycarbonate resin is generally polycarbonate from bisphenol A and phosgene.

The (7) polyether resin (or acetal resin), for example, may be polyether resin such as polyethylene oxide and polypropylene oxide, and acetal resin such as polyoxymethylene obtained through ring-opening-polymerization.

The (8) other resins may be polyurethane resin obtained through additional-polymerization.

As for the image-recording material when the image-receiving layer is a toner image-receiving layer for electrophotography, the color material is a toner.

When the image-receiving layer is the image-receiving layer for ink-jet recording, the color material is an ink. When the image-receiving layer is an image-receiving layer for melting heat transfer and an image-receiving layer for sublimation heat transfer, the color material is a transfer material (donor film). In the case of heat sensitive recording layer, the color material is comprised in the heat sensitive recording layer.

The image-recording material is not limited and may be suitably selected according to the purpose, for example, can be an electrophotographic image-receiving sheet, a melting heat-transfer recording sheet, a sublimation-heat-transfer recording sheet, a heat-sensitive recording sheet, and an ink-jet recording sheet.

The ink-jet recording sheet, for example, comprises a support, and a porous-structured color-material-receiving layer is disposed on the support, in the color-material-receiving layer the following ink is absorbed in order to form an image. Examples of inks include liquid ink such as aqueous ink, which uses dye or pigment as a color material and oil ink, and solid ink a solid ink which is solid at room temperature and which is melted and liquefied when used for a print, and the like.

The electrophotographic image-receiving sheet, for example, comprises a support, and at least a toner image-receiving layer is disposed on the support, and the toner image-receiving layer receives at least one of color toner and black toner, and thereby an image is formed.

The melting heat-transfer recording sheet, for example, comprises a support, and at least a heat-melting ink layer as an image-recording layer is disposed on the support, and is used in a method of transferring melted ink from heat-melting ink layer on a thermal transfer recording sheet by heating with a thermal head.

The sublimation-heat-transfer recording sheet comprises a support, and at least an ink layer comprising heat diffusive dye (subliming dye) is disposed on the support, and is used in a method of transferring sublimated heat diffusive dye from ink layer on a thermal transfer recording sheet by heating with a thermal head.

The heat-sensitive recording sheet comprises a support, and at least a heat-coloring layer is disposed on the support, and may be a heat-sensitive material used in a thermo-autochrome method (TA method) in which a repetition of heating by a thermal head and fixing by ultraviolet ray records an image.

For the image-recording process and image-recording apparatus, it is preferable to use an image-recording material in roll configuration from the viewpoint of high speediness, cost, and saving.

The roll-cutting unit is a unit to cut an image-recording material in roll configuration to fixed size image-recording material.

The roll-cutting unit is not limited and may be suitably selected according to the purpose, for example, may be circular cutter, guillotine cutter, and rotary cutter.

The size of the image-recording material is not limited and may be suitably selected according to the purpose, for example, can be L size (89 mm×127 mm), A6 size (105 mm×150 mm), A4 size (210 mm×300 mm), postcard size, and business card size.

Further, one or more of roll paper feeding unit, equipped with an image-recording material sheet in roll configuration, may be provided inside the image-recording apparatus. In addition, a bundle of cut papers contained in a sheet tray may be fed in place of or in combination with the roll configuration.

<Image Recording Unit and Image Recording>

The image-recording unit, as long as it can record an image in the image-recording material, is not limited and may be suitably selected from among the well-known image-recording apparatus, and it is preferable to be able to record an image, according to the well-known image-recording process, for example, ink-jet recording process, heat-sensitive recording process, silver halide photographic process, silver halide digital photographic process, heat-development process, and electrophotographic process. Among them, image-forming apparatus of electrophotographic process is preferable in particular.

Here, an image-forming apparatus of the electrophotographic method comprises at least an electrostatic latent image carrier, electrostatic latent image-forming unit, developing unit, transferring unit, and fixing unit, and further according to necessity, comprises suitably selected other units, for example, charge eliminating unit, cleaning unit, recycle unit, and controlling unit.

The image-recording method comprises at least electrostatic latent image forming, developing, transferring, and fixing, and further according to necessity, for example, comprises suitably selected other charge eliminating, cleaning, recycling, and controlling.

The image-recording method can be carried out suitably by the image-forming apparatus, and the electrostatic latent image forming can be performed by the electrostatic latent image-forming unit, and the developing can be carried out by the developing unit, and the transferring can be carried out by the transferring unit, and the fixing can be carried out by the fixing unit, and the others can be carried out by the other units.

Electrostatic Latent Image Forming and Electrostatic Latent Image Forming Unit

The electrostatic latent image forming forms an electrostatic latent image on an electrostatic latent image carrier.

The electrostatic latent image carrier (named as "photoconductive insulator", "photoconductor") is not limited for the material, shape, structure, and size, and may be suitably selected from among the well-known carriers, and for the shape, drum shape is suitably selected, and examples of the material include inorganic photoconductor such as amorphous silicon and selenium, and organic photoconductor such as polysilane and phthalopolymethine. Among them, amorphous silicon is preferable because of long life time property.

The electrostatic latent image forming, for example, after the surface of the electrostatic latent image carrier is charged equally, can be performed by exposing imagewisely by an electrostatic latent image-forming unit.

The electrostatic latent image-forming unit, for example, is provided with at least a charger charging equally the surface of the electrostatic latent image carrier and an exposure device exposing the surface of the electrostatic latent image carrier imagewisely.

The charge, for example, may be performed by applying a voltage on the surface of the electrostatic latent image carrier using the charger.

The charger is not limited and may be suitably selected according to the purpose, for example, can be contact charger, itself well known, provided with conductive or semiconductive roller, brush, film, and rubber blade, and non-contact charger using corona discharge such as corotron and scorotron.

The exposure, for example, may be performed by exposing the surface of the electrostatic latent image carrier imagewisely using the exposure device.

The exposure device, as long as it can expose imagewisely the surface of the electrostatic latent image carrier charged by the charger, is not limited and may be suitably selected according to the purpose, for example, may be various exposure devices such as copy optics, rod lens array, laser optics, and liquid shutter optics.

For the present invention, lighting back surface method may be adopted, in which the electrostatic latent image is exposed imagewisely from the back surface.

Developing and Developing Unit

The developing forms visible image by developing the electrostatic latent image using the toner or the developer.

The forming the visible image, for example, may be performed by developing the electrostatic latent image using the toner or the developer, and may be performed by the developing unit.

The developing unit, as long as it can develop using the toner or the developer, is not limited and may be suitably selected from the well-known units, for example, comprises at least a developing device capable of storing the toner or the developer and applying the toner or the developer to the electrostatic latent image by contact or without contact. More preferably a developing device provides with a container containing the toner.

The developing device may be by a dry developing method, or a wet developing method, may be by a single color developing device or a multi-color developing device. Examples include a device comprises a stirrer configured to friction stir to charge the toner or the developer, and a magnet roller capable of rotating, and the like.

Inside of the developing device, for example, the toner and the carrier are mixed and stirred, the toner is thereby charged by the friction and kept at standing state on the surface of the rotated magnet roller, and then magnet brush is formed. Since the magnet roller is arranged near the electrostatic latent image carrier (photoconductor), a part of the toner in the magnetic brush formed on the surface of the magnet roller moves toward the surface of the electrostatic latent image carrier (photoconductor) due to the force of electrical attraction. As a result, the latent electrostatic image is developed by use of the toner, and a visible image is formed on the surface of the electrostatic latent image carrier (photoconductor).

The developer stored in the developing device contains a toner, however, as a developer; it may be a one component developer, or a binary developer. The toner comprised in the developer is the above-mentioned toner.

Transferring and Transferring Unit

The transferring transfers the visible image to a recording medium, a preferable aspect is that an intermediate transfer is used, and after primary transferring a visible image on the intermediate transfer, secondary transferring the visible image on the recording medium. More preferably, an aspect in which two or more colors, preferably a full-color toner is used as the toner, and comprises a primary transferring transferring a visible image on an intermediate transfer to form a complex transferred image, and a secondary transferring transferring the complex transferred image on the recording medium.

The transferring the visible image, for example, may be performed by charging the electrostatic latent image carrier (photoconductor) by using a transfer charger, and can be performed by the transferring unit. The transferring unit is preferably an aspect comprising a primary transferring unit transferring a visible image on an intermediate transfer to form a complex transferred image and a secondary transferring unit transferring the complex transferred image on the recording medium.

The intermediate transfer is not limited and may be suitably selected from the well-known transfers according to the purpose, for example, may be preferably a transfer belt.

The transferring unit (the primary transferring unit and the secondary transferring unit) preferably comprises at least a transfer device in which the visible image formed on the electrostatic latent image carrier (photoconductor) is peeled to transfer to the recording medium by charging. The transferring unit may be one, or more.

The transfer device may be a corona transfer device by corona discharge, a transfer belt, a transfer roller, a pressure transfer roller, and an adhesive transfer device, and the like.

The recording medium, representatively, a ordinary paper, is not limited as long as an undefined image may be transferred after developing, and may be suitably selected according to the purpose, PET base for OHP can also be used.

The fixing fixes a visible image transferred on the recording medium using a fixing apparatus, and may be performed at every transferring a visible image to the recording medium for the toner of each color, or once at the same time in a laminated state for toner of each color.

The fixing apparatus is not limited and may be suitably selected according to the purpose; however, well-known heating and pressurizing units are suitable. Examples of the heating and pressurizing units include a combination of heating roller and pressurizing roller, and a combination of heating roller, pressurizing roller and endless belt, and the like.

The heating in the heating and pressurizing unit is generally 80° C. to 200° C. is preferable.

According to the purpose, for example, the well-known light fixing device may be used alternatively or together with the fixing and fixing unit.

The charge eliminating performs charge eliminating by applying bias to the electrostatic latent image carrier and may be performed suitably by a charge eliminating unit.

The charge eliminating unit is not limited as long as it can apply bias to the electrostatic latent image carrier, may be suitably selected from among well-known charge eliminating devices, for example, may be a charge eliminating lamp.

The cleaning removes the toner remained on the electrostatic latent image carrier and may be performed by a cleaning unit.

The cleaning unit is not limited as long as it can remove the electrophotographic toner remaining on the electrostatic latent image carrier, may be suitably selected from well-known cleaners, for example, a magnetic brush cleaner, an electrostatic brush cleaner, a magnetic roller cleaner, a blade cleaner, a brush cleaner, and a web cleaner.

The recycling recycles the color toner for electrophotography removed by the cleaning to the developing unit and may be performed by a recycle unit.

The recycle unit is not limited and may be a well-known conveying unit, and the like.

The controlling controls each step and may be performed suitably by a controlling unit.

The controlling unit is not limited, as long as it can control the movement of the above-mentioned each unit, and may be suitably selected according to the purpose, for example, equipments such as a sequencer and a computer, and the like.

Figure 3:
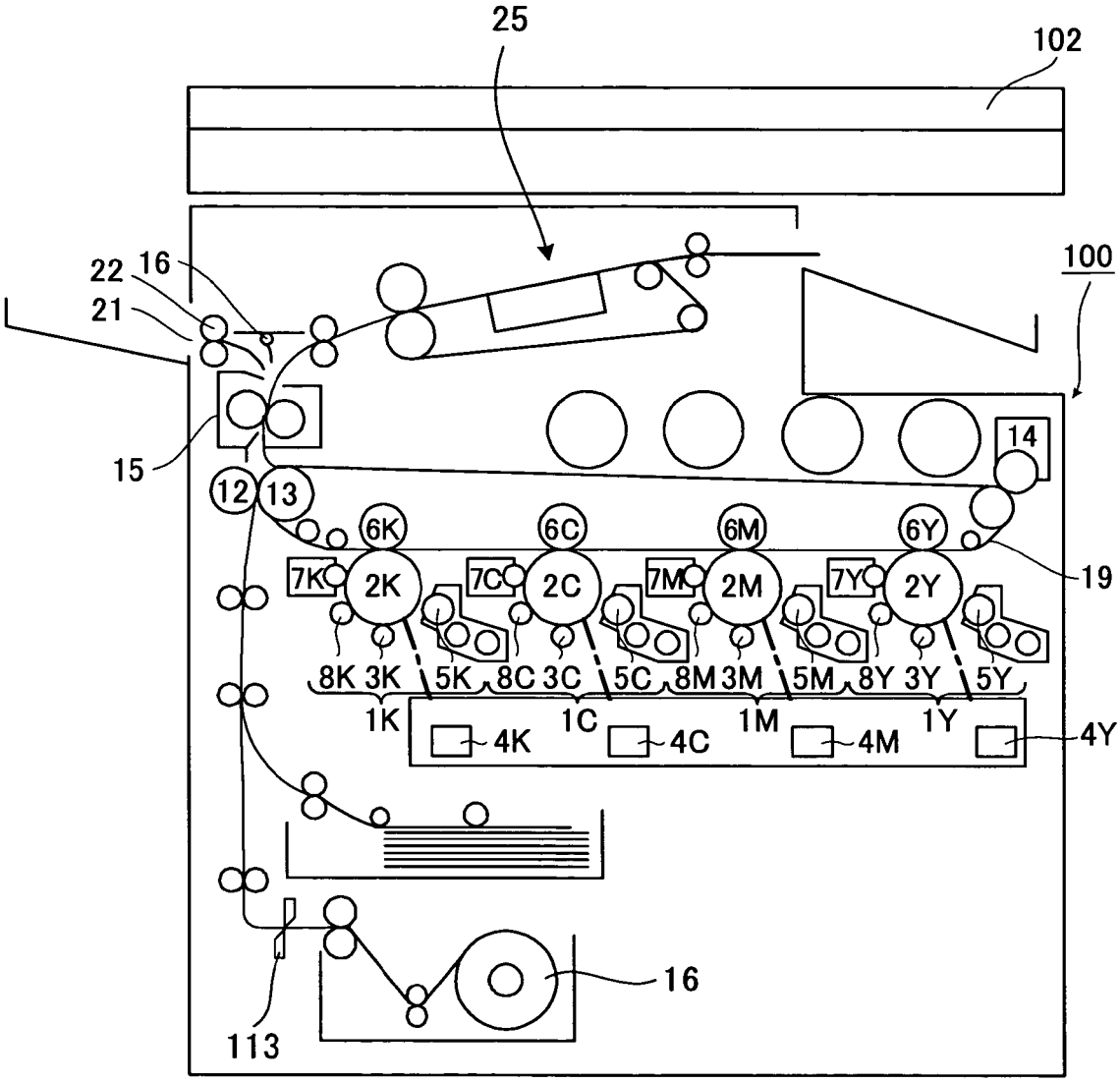
FIG. 3 is a schematic diagram showing an example of an image-forming apparatus of the present invention.

FIG. 3 is a schematic diagram of a tandem-type color copying machine (image-forming apparatus) capable of high speed recording.

Figure 4:
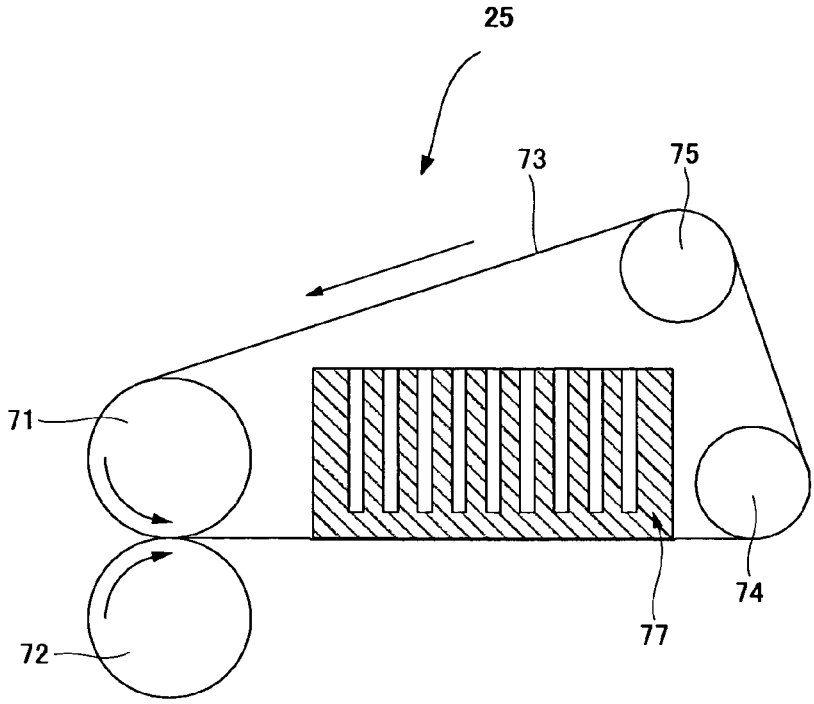
FIG. 4 is a schematic diagram showing an example of a belt fixing apparatus of FIG. 3.

This image-forming apparatus comprises apparatus main body 100 and image reading apparatus (manuscript reading unit) 102. In the apparatus main body, belt fixing unit 25 as an image output part and a second fixing unit, and rolled electrophotographic image-receiving sheet 16, and roll cutter 113 are arranged. The image output part comprises first fixing unit (first fixing unit) 15 and image-forming part (image-forming unit). As the second fixing unit 25, the belt fixing unit is employed as shown in FIG. 4.

The image-forming part is provided with intermediate transfer belt 19 of endless type which is spanned over plural tension rollers and is rotated, and electrophotographic image-forming unit 1Y, 1M, 1C and 1K forming each color toner image of yellow, magenta, cyan, black arranged from the upstream to the downstream of the rotating direction of the intermediate transfer belt 19, and belt cleaning unit 14 facing intermediate transfer belt 19, and secondary transfer roller 12 facing intermediate transfer belt 19, a pair of conveyer rollers, a pair of resist rollers, a pair of first discharge rollers, a pair of second discharge rollers, and second discharge tray.

Also, each electrophotographic image-forming unit 1Y, 1M, 1C and 1K is provided with photoconductor drum 2Y, 2M, 2C, and 2K, charger 3Y, 3M, 3C, and 3K, developing unit 5Y, 5M, 5C, and 5K, primary transfer roller 6Y, 6M, 6C, and 6K, photoconductor cleaning unit 7Y, 7M, 7C, and 7K, and charge eliminating device 8Y, 8M, 8C, and 8K, respectively.

In the image-forming apparatus shown in FIG. 3, each image information of black, yellow, magenta, and cyan is transmitted to each image-forming unit in tandem image-forming apparatus (black image-forming unit 1K, yellow image-forming unit 1Y, magenta image-forming unit 1M, and cyan image-forming unit 1C), respectively, and in each image-forming unit, each toner image of black, yellow, magenta, and cyan is formed. Namely, each image-forming unit in the tandem image-forming apparatus (black image-forming unit 1K, yellow image-forming unit 1Y, magenta image-forming unit 1M, and cyan image-forming unit 1C), as shown in FIG. 3, is provided with photoconductor 2 (black photoconductor 2K, yellow photoconductor 2Y, magenta photoconductor 2M, and cyan photoconductor 2C), and charger 3 charging the photoconductor uniformly, and the exposure device exposing the photoconductor imagewisely corresponding to each color image based on each color image information to form the electrostatic latent image corresponding to each color image on the photoconductor, and developing device 5 developing the electrostatic latent image using each color toner (black toner, yellow toner, magenta toner, and cyan toner) to form the toner image by each color toner, charger 3 transferring the toner image on intermediate transfer 19, and photoconductor cleaning unit 7, and charge eliminating device 8, respectively, and is capable of forming each single color image (black image, yellow image, magenta image, and cyan image) based on each color image information respectively.

Thereby, the black image, yellow image, magenta image, and cyan image formed in which black image formed on black photoconductor 2K, yellow image formed on yellow photoconductor 2Y, magenta image formed on magenta photoconductor 2M, and cyan image formed on cyan photoconductor 2C are transferred one by one (primary transferring), respectively, on intermediate transfer 19 rotated and moved by the support roller. And, on intermediate transfer 19, the black image, yellow image, magenta image, and cyan image are superimposed, thereby a combined color image (color transfer image) is formed.

Next, the belt fixing unit 25, as shown in FIG. 4, is provided with heating roller 71, peeling roller 74 comprising the heating roller 71, endless belt 73 supported rotatably by tension roller 75, and pressure roller 72 contacting the heating roller 71 by pressing through endless belt 73.

The inner surface of endless belt 73, cooling heat sink 77 forcibly cooling endless belt 73 is arranged in between heating roller 71 and peeling roller 74, and by cooling heat sink 77, the cooling and sheet conveyer part cooling electrophotographic image-receiving sheet and conveying the sheet is consisted.

In the belt fixing unit 25, as shown in FIG. 4, the electrophotographic transfer sheet in which color toner image is transferred and fixed on the surface, is introduced to the contact part (nip part) where heating roller 71 contacts pressure roller 72 by pressing through endless belt 73 so as to the color toner image is positioned to face heating roller 71, and when the electrophotographic transfer sheet passing through the contact part of the heating roller 71 and pressure roller 72, the color toner image T is heated, melted and thereby fixed on the electrophotographic transfer sheet.

After that, at the contact part of the heating roller 71 and pressure roller 72, for example, the toner is practically heated to approximately 120° C. to 130° C., and melted, and the electrophotographic image-receiving sheet in which the color toner image is fixed on the image-receiving layer, at a state where the surface of the image-receiving layer is attached to the surface of endless belt 73, is conveyed together with endless belt 73. While this, endless belt 73 is cooled forcibly by cooling heat sink 77, the color toner image and the image-receiving layer, after cooled and hardened, is peeled by the stiffness (rigidity) of the electrophotographic image-receiving sheet itself by peeling roller 74.

The surface of endless belt 73 after peeling is completed, the residual toner is removed by a cleaner (not shown) and is prepared for the next fixing.

<Curl Controlling and Curl Controlling Unit>

The curl controlling, after heating the image-recording material to a temperature higher than the glass transition temperature of the thermoplastic resin in the thermoplastic resin contained layer, controls the curl by contacting the image-recording material with a curl controlling member while the image-recording material is cooled to a temperature below the glass transition temperature (Tg).

The heating unit is not limited and may be suitably selected according to the purpose, for example, a pair of heating roller, heating roller and pressure roller, heating by warm air, and a heat panel, and the like.

The cooling unit is not limited and may be suitably selected from well-known cooling apparatuses according to the purpose, for example, an apparatus capable of blowing cold air and capable of controlling the cooling temperature, and a heat sink.

In this case, the thermoplastic resin in the thermoplastic resin contained layer is preferably at least any one selected from an image-receiving layer, a color material layer, an intermediate layer, a support, a backing layer, and a combination thereof. When the thermoplastic resin is used in plural layers and as a color material, the glass transition temperature of the layer that has the most thermoplastic resin content is adopted.

At a temperature of glass transition temperature ±10° C. of the thermoplastic resin, it is preferable to contact a curl controlling member with an image-recording material, more preferably a glass transition temperature ±5° C. of the thermoplastic resin, and most preferably the glass transition temperature of the thermoplastic resin.

In this case, it is preferable to control at least any one of the direction and size of the curl, and the curl controlling member comprises a curved shape on its surface, and it is more preferable to control the curl by changing at least any one of the curvature radius and curved surface length of the curved shape.

Figure 2:
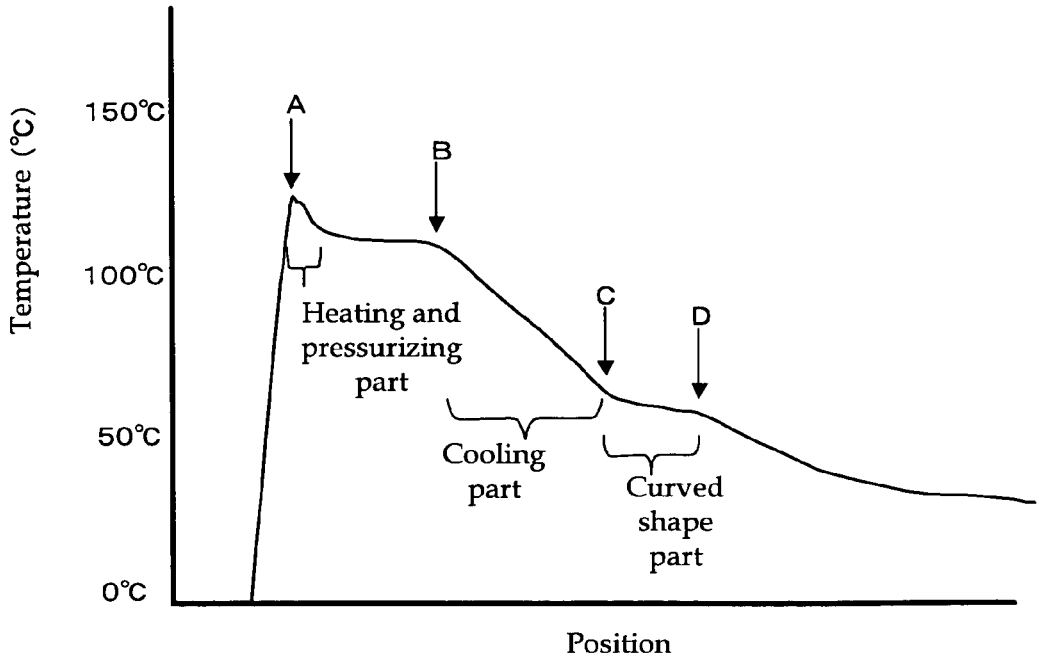
FIG. 2 is a graph showing a temperature change of the image-receiving sheet at the A to D position of FIG. 1.

Here, an image-recording material (for example, image-receiving sheet) shows the temperature change as shown in FIG. 2 by the belt curl controlling device shown in FIG. 1.

The image-receiving sheet, firstly, is heated at heating and pressurizing roller 31 and 32 up to approximately 130° C., which is more than the glass transition temperature of the thermoplastic resin comprised in the image-receiving sheet, and conveyed to cooling unit 37. Then, in between B and C, the image-receiving sheet is cooled to the glass transition temperature vicinity. Then, in between C and D, the curl of desired direction and size is given on the image-receiving sheet by the function of curl controlling member 34. Here, in between C and D, the temperature of the image-receiving sheet is a glass transition temperature ±10° C. of the thermoplastic resin, and the curl of desired direction and size can be given effectively.

The temperature change of the image-receiving sheet, for example, may be measured by using thermocouple thermometer.

The curl controlling unit preferably comprises at least any one of image fixing member and curl controlling member, and thereby the curl controlling can be work with the image fixing.

Examples of the image fixing member, may be a pair of heating and pressurizing roller, and a combination of a pair of heating and pressurizing roller and a fixing belt, and the like.

Examples of the curl controlling member may be a guide roller capable of controlling a position, a roller capable of moving up and down, and various pressurizing members, and the like.

Furthermore, the curl controlling member with the cooling function can cool effectively to the glass transition temperature of the thermoplastic resin.

The curl controlling unit, for example, may be preferably a belt curl controlling device.

In the first embodiment, the belt curl controlling device comprises a first endless belt part comprising a first heating roller and a first tension roller, and a first endless belt which is spanned rotatably over the first heating roller and the first tension roller, and a second endless belt part comprising a second heating roller and a second tension roller, and a second endless belt which is spanned rotatably over the second heating roller and the second tension roller, and an intersection angle between a line perpendicular to the line that connects the rotation axes of the first and the second tension rollers and a direction line that image-recording material travels to the first and the second tension rollers is 1° to 20°.

In this case, it is preferably configured to be able to control the curved shape of the curl controlling member formed from the first and second endless belt parts by changing the up-down and front-back positional relation of at least any one of the first and second tension roller.

Figure 5:
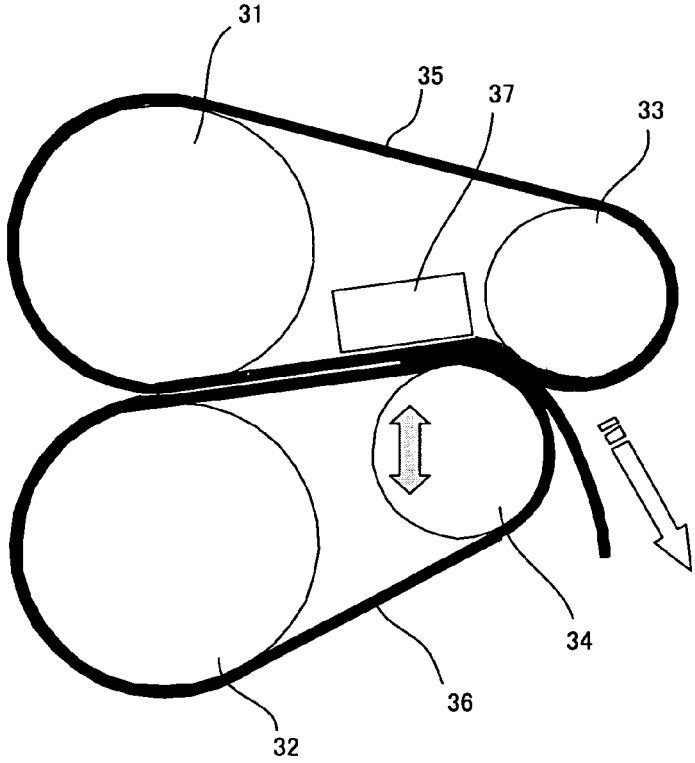
FIG. 5 is a schematic diagram showing a belt curl controlling device used in example 1.

In the first embodiment, the belt curl controlling device for example, is the one shown in FIG. 5. The belt curl controlling device shown in FIG. 5 comprises a first endless belt part comprising first heating roller 31 and first tension roller 33, and first endless belt 35 which is spanned rotatably over first heating roller 31 and first tension roller 33, and a second endless belt part comprising second heating roller 32 and second tension roller 34, and a second endless belt 36 which is spanned rotatably over second heating roller 32 and second tension roller 34. In FIG. 5, 37 is the cooling unit, capable of blowing cold air, and a cooling unit and a heat sink capable of controlling the cooling temperature, and the like are used.

In this first embodiment, the curved shape can be suitably controlled by changing the position of second tension roller 34 to up-down and front-back direction.

In the second embodiment, the belt curl controlling device comprises a first endless belt part comprising a first heating roller and a first tension roller, and a first endless belt which is spanned rotatably over the first heating roller and the first tension roller, and a second endless belt part comprising a second heating roller and a second tension roller, and a second endless belt which is spanned rotatably over the second heating roller and the second tension roller, and a curl controlling member, and the first and second heating rollers are arranged so as to be possibly contacted with the image-recording material through each endless belt.

In this case, the curl controlling member is arranged in an inside of at least any one of the first endless belt part and the second endless belt part, and is preferably arranged so as to contact the inner surface of endless belt.

Figure 7:
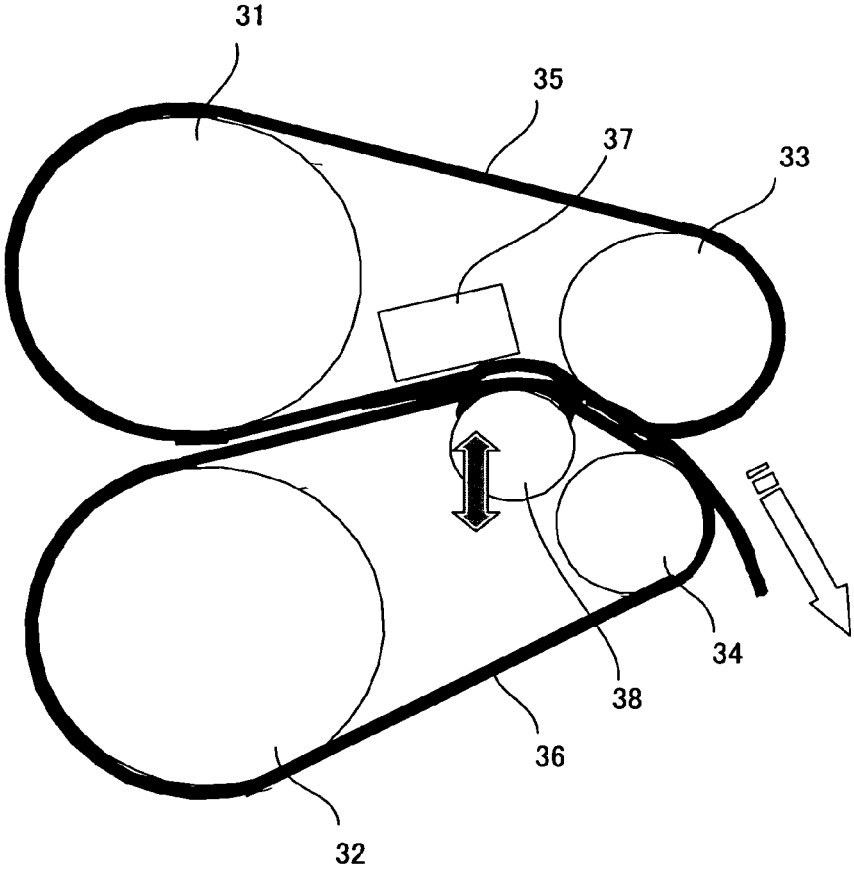
FIG. 7 is a schematic diagram showing a belt curl controlling device used in example 2.
Figure 8:
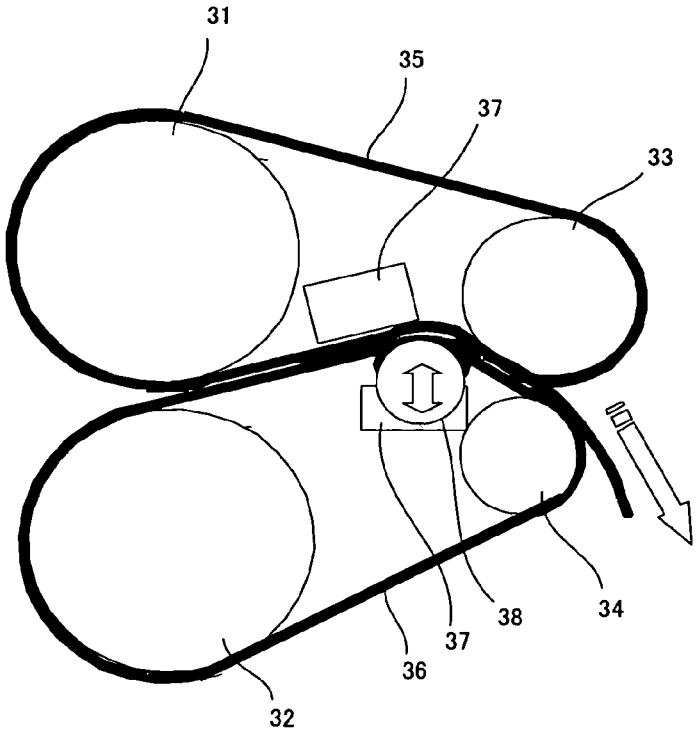
FIG. 8 is a schematic diagram showing a belt curl controlling device used in example 3.

In the second embodiment the belt curl controlling device is shown in FIG. 7 and FIG. 8.

The belt curl controlling device shown in FIG. 7 and FIG. 8 comprises a first endless belt part comprising first heating roller 31 and first tension roller 33, and first endless belt 35 which is spanned rotatably over first heating roller 31 and first tension roller 33, and a second endless belt part comprising second heating roller 32 and second tension roller 34, and a second endless belt 36 which is spanned rotatably over second heating roller 32 and second tension roller 34, and curl controlling member 38.

In FIG. 7, the curl controlling member 38 is the roller capable of rotating, and can give the curl of desired direction and size to the image-recording material by moving up-down and front-back.

In FIG. 8, the curl controlling member 38 is the roller capable of rotating and comprises a cooling unit, and can give the curl of desired direction and size to the image-recording material by moving the roller up-down and front-back.

In a third embodiment, the belt curl controlling device comprises a first endless belt part comprising a first heating roller and a first tension roller, and a first endless belt which is spanned rotatably over the first heating roller and the first tension roller, and a second endless belt part comprising a second heating roller and a second tension roller, and a second endless belt which is spanned rotatably over the second heating roller and the second tension roller, and a curl controlling member, and the first and second heating rollers are arranged so as to be possibly contacted with the image-recording material through each endless belt.

In this case, the curl controlling member is arranged in the outside of the first endless belt part and the second endless belt part, and preferably in the direction of the image-recording material being discharged.

Figure 9:
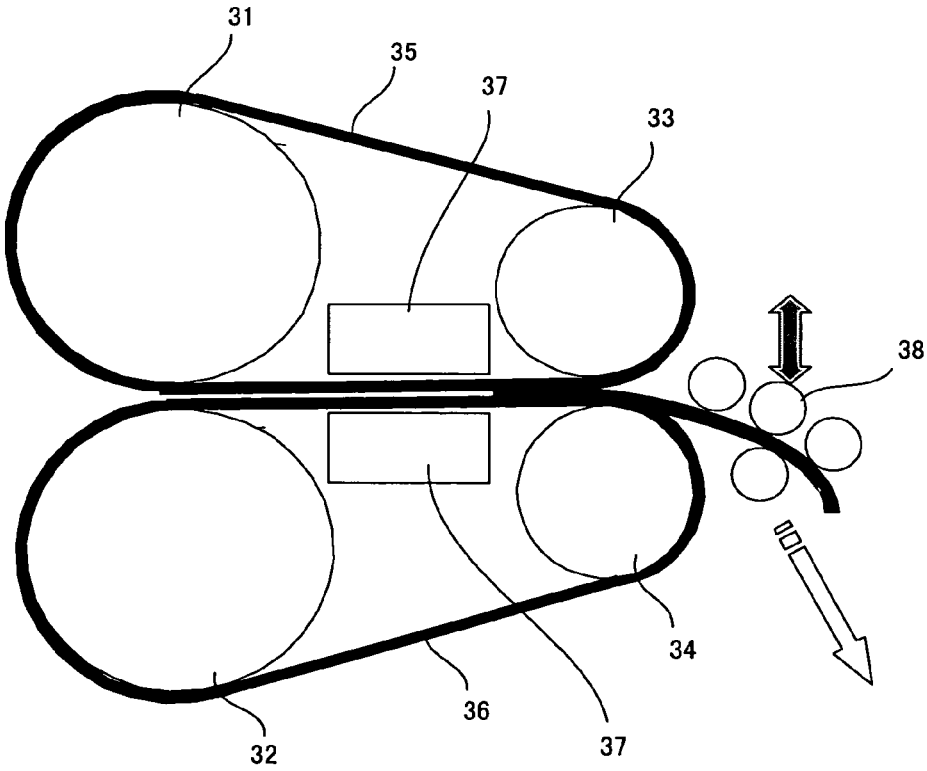
FIG. 9 is a schematic diagram showing a belt curl controlling device used in example 4.

In the third embodiment the belt curl controlling device is shown in FIG. 9.

The belt curl controlling device shown in FIG. 9 comprises a first endless belt part comprising first heating roller 31 and first tension roller 33, and first endless belt 35 which is spanned rotatably over first heating roller 31 and first tension roller 33, and a second endless belt part comprising second heating roller 32 and second tension roller 34, and a second endless belt 36 which is spanned rotatably over second heating roller 32 and second tension roller 34, and curl controlling member 38.

The curl controlling member is plural lined up guide rollers, and can give the curl of desired direction and size to the image-recording material by changing the arrangement of the rollers.

Figure 10:
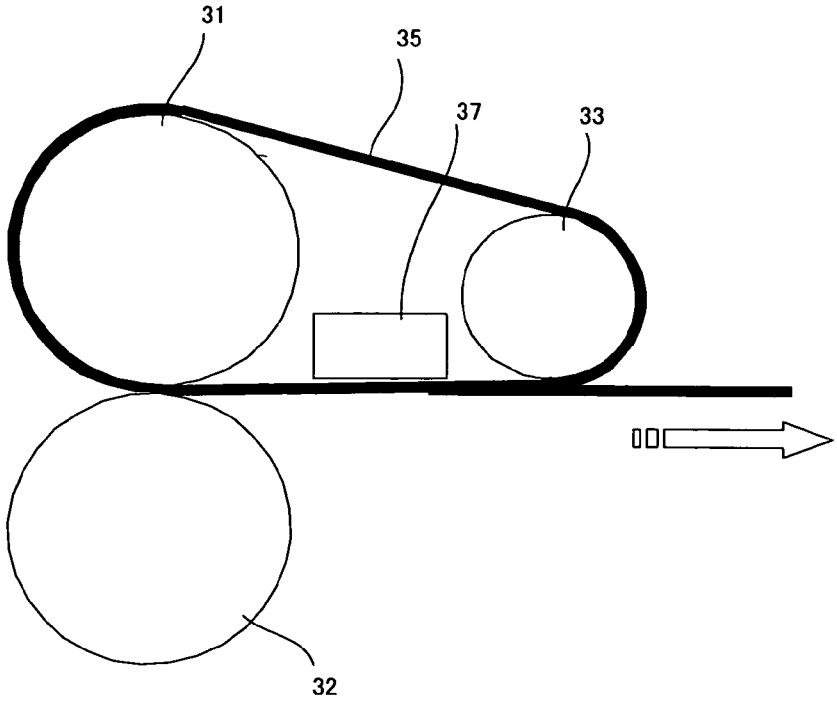
FIG. 10 is a schematic diagram showing a belt curl controlling device used in comparative example 1.
Figure 11:
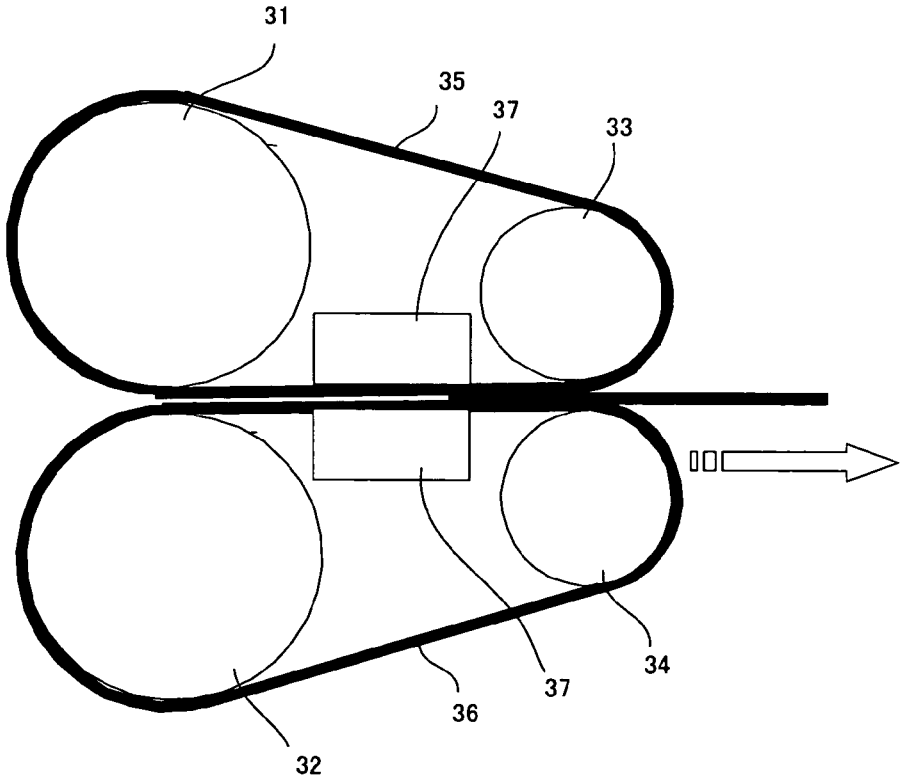
FIG. 11 is a schematic diagram showing a belt curl controlling device used in comparative example 2.

FIG. 10 and FIG. 11 show the conventional belt fixing devices with an object for smoothing and glossing treatment.

Hereafter, the present invention will be described by means of examples, but it will be understood that the invention should not be construed as being limited thereby.

EXAMPLES

Example 1

<Manufacturing of Electrophotographic Image-Receiving Sheet>

Preparation of Raw Paper

The paper materials, LBKP made of acacia prepared to Canadian Freeness of 30 ml using a disk refiner, and LBKP made of aspen prepared to Canadian Freeness 300 ml using a disk refiner were mixed with a composition of acacia 25% by mass and aspen 75% by mass, and thereby obtained the pulp slurry.

The obtained pulp slurry was prepared by adding, per pulp, cationic starch (manufactured by Japan NSC, CATO 304L) 1.3% by mass, anionic polyacrylamide (manufactured by Seiko Polymer Corporation, polyakron ST-13) 0.145% by mass, alkylketene dimer (manufactured by Arakawa Chemical Industries, Ltd., Sizepine K) 0.285% by mass, polyamide-polyamine-epichlorohydrin (manufactured by Arakawa Chemical Industries, Ltd., Arafix 100) 0.32% by mass, and then, further adding the defoaming agent 0.12% by mass.

Next, the prepared pulp slurry was made into paper by a fourdrinier, the surface of the web was pressed and dried by a drum dryer cylinder through a dryer canvas, and thereby obtained a long-sheet raw paper. The tensile force of the dryer canvas was fixed to 1.6 kg/cm. 1 g/m$^2$ of Polyvinyl alcohol (manufactured by Kuraray Co., Ltd., KL-118) was coated and dried on both surfaces of the obtained raw paper by a side press, and then calendar treatment was performed.

It was made so that the basis weight became 163 g/m$^2$, and a long-sheet raw paper of 160 μm thick was obtained.

Next, on the surface of the obtained long-sheet raw paper, which is the opposite surface of the toner image-receiving layer being disposed, the polyethylene resin of composition shown in Table 1 was laminated by extruding in a single layer using the cooling roll of which surface roughness of matte surface was 10 μm, at melt discharge film temperature 310° C. and linear speed 250 m/min, and thereby disposed the back surface polyethylene resin layer of 22 μm thick.

TABLE 1

| Composition | MFR (g/10 min) | Density (g/cm$^3$) | Amount of additives (% by mass) |
|---|---|---|---|
| High density polyethylene | 12 | 0.967 | 55 |
| Low density polyethylene | 3.5 | 0.923 | 45 |

Next, on the surface of the raw paper in which the toner image-receiving layer was disposed, a mixture of the same low density polyethylene as in Table 1, the pellet in which $TiO_2$ was masterbatched as shown in Table 2, and the pellet containing 5% by mass of ultramarine blue was masterbatched, so that the final composition became as shown in Table 3, was laminated by extruding in a single layer using the cooling roll of which surface roughness of matte surface was 0.7 μm, at linear speed 250 m/min, and thereby disposed the front surface polyethylene resin layer of 29 μm thick.

After that, on the front surface polyethylene resin layer and on the back surface polyethylene resin layer, corona discharge treatment of 18 kW and 12 kW, were performed respectively. Then, on the front surface polyethylene resin layer and on the back surface polyethylene resin layer, gelatin undercoat layer of 0.06 g/m$^2$ at dry mass and gelatin undercoat layer of 0.038 g/m$^2$ at dry mass, were disposed respectively. Thereby, long-sheet support was prepared.

TABLE 2

| Composition | Content (% by mass) |
|---|---|
| Low density polyethylene ($\rho$ = 0.921 g/cm$^3$) | 37.98 |
| Anatase titanium dioxide | 60 |
| Zinc stearate | 2 |
| Anti-oxidant | 0.02 |

TABLE 3

| Composition | Content (% by mass) |
|---|---|
| Low density polyethylene ($\rho$ = 0.921 g/cm$^3$) | 67.7 |
| Anatase titanium dioxide | 30 |

TABLE 3-continued

| Composition | Content (% by mass) |
|---|---|
| Zinc stearate | 2 |
| Untramarine blue | 0.3 |

Preparation of Coating Solution for Intermediate Layer

The following components were mixed and stirred to prepare the coating solution for intermediate layer.

| | |
|---|---|
| Water-dispersed acrylic resin (Hiross X-XE240, manufactured by Seiko Polymer Corporation, glass transition temperature (Tg) = 15° C., acid value 82, solid content 42% by mass, ammonia content 0.98%) | 100 parts by mass |
| Water-dispersed acrylic resin (PDX7325, manufactured by Johnson Polymer Corporation, glass transition temperature (Tg) = 66° C., acid value 61, solid content 45% by mass, ammonia content 0.77%) | 100 parts by mass |
| Polyethylene oxide (Alkox R1000, manufactured by Meisei Chemical Industries Co., Ltd.) | 2.5 parts by mass |
| Anionic surface-active agent (Rapyzoyl A90, manufactured by Nippon Oil & Fats Co., Ltd.) | 1.2 parts by mass |
| Ion exchange water | 60 parts by mass |

Preparation of Titanium Dioxide Dispersion Liquid

The following components were mixed and dispersed by using Nissei Corporation manufactured NBK-2 to prepare the titanium dioxide dispersion liquid.

| | |
|---|---|
| Titanium dioxide (TIPAQUE (registered Trademark)R-780-2, manufactured by Ishihara Sangyo Kaisha, Ltd.) | 48 parts by mass |
| Polyvinyl alcohol (PVA 205 C, manufactured by Kuraray Co., Ltd.) | 6 parts by mass |
| Surface-active agent (Demol EP, manufactured by Kao Corporation) | 0.6 parts by mass |
| Carbon black (10B, manufactured by Mitsubishi Chemical Corporation) | 0.06 parts by mass |
| Ion exchange water | 65.6 parts by mass |

Preparation of Coating Solution for Toner Image-Receiving Layer

The following components were mixed and stirred to prepare the coating solution for toner image-receiving layer.

| | |
|---|---|
| The above-mentioned titanium dioxide dispersion | 15.5 parts by mass |
| carnauba wax water-dispersed compound (Serozol 524, manufactured by Chukyo Yushi Co., Ltd.) | 10 parts by mass |
| water-dispersed polyester resin (water-dispersed polymer of self-dispersed) (solid content 35% by mass, acid component: terephthalic acid, alcohol component: ethylene glycol, neopentyl glycol, ethylene oxide addition product of bisphenol A, counter cation = $NH_4^+$ (ammonium ion), acid value 18, volume average particle diameter = 150 nm, number average molecular mass (Mn) = 6000) | 200 parts by mass |
| Polyethylene oxide (Alkox R1000, manufactured by Meisei Chemical Industries Co., Ltd.) | 4.8 parts by mass |
| Anionic surface-active agent (Rapizol A90, manufactured by Nippon Oil & Fats Co., Ltd.) | 1.5 parts by mass |
| Particles (matte agent, MX2000, manufactured by Souken Chemical Corporation) | 1.8 parts by mass |
| Ion exchange water | 128.7 parts by mass |

The glass transition temperature (Tg) of water-dispersed polyester resin was 70° C., the melting point of polyethylene oxide was 66° C., the melting point of carnauba wax water-dispersed compound was 83° C., the composition of the matte agent (MX2000) is polymethyl methacrylate crosslinked compound.

Coating of Toner Image-Receiving Layer and Coating of Intermediate Layer

On the surface of the obtained band-shaped support, the coating solution for intermediate layer and coating solution for toner image-receiving layer were filtered by 400 mesh filter (effective filtration accuracy 40 μm or less), and simultaneously coated double layers by using a slide coater.

The coating solution for intermediate layer and coating solution for toner image-receiving layer were coated so that the coating amount for the intermediate layer was 5.0 g/m$^2$ at dry mass and for the toner image-receiving layer was 7.5 g/m$^2$ at dry mass.

The intermediate layer and toner image-receiving layer, after coating, were dried by the hot air at 100° C. for 20 seconds, thereby obtained that the toner image-receiving layer of 7 μm thick, and the intermediate layer of 5 μm thick. Thus, the electrophotographic image-receiving sheet of example 1 was prepared.

The obtained electrophotographic image-receiving sheet was in roll configuration with the toner image-receiving layer disposed outside, in which the size of the toner image-receiving layer was the outermost diameter of 120 mm, the innermost diameter of 30 mm, and the width of 297 mm. And, the long sheet feeding from the rolled electrophotographic image-receiving sheet was automatically cut to a length of 210 mm, and used in the following image forming.

<Image Forming>

Figure 6:
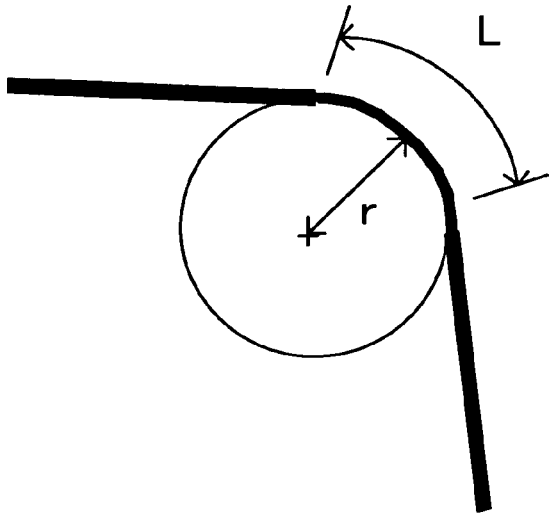
FIG. 6 is a diagram describing a curvature radius (r) and a curved length (L) of a curl controlling unit.

Then, image forming was carried out on the obtained electrophotographic image-receiving sheet, in the following condition, by means of the image-forming apparatus which is the electrophotographic printer as shown in FIG. 3 whose fixing unit is modified to a belt-type curl controlling device shown in FIG. 5 under the atmosphere of 23° C. and 55% relative humidity, the even image of 10 cm four-way at the highest density of black color was printed, and after being printing, fixed by putting the surface of the print upward. The curved shape (polarity, curvature radius, curved length) of the electrophotographic print in the curl controlling was controlled as shown in Table 4. Here, curvature radius (r) and curved length (L) are as shown in FIG. 6. The polarity of the curved where the image surface was a convex shape was denoted by plus, and the polarity of the curved where the image surface was a concave shape was denoted by minus.

Toner

The glass transition temperature (Tg) of the binder of the toner was 53° C.

Belt

The support of the belt: polyimide (PI) film, width of 50 cm, thickness of 80 μm Belt releasing layer material: SIFEL610, a fluorocarbon siloxane rubber precursor (manufactured by Shin-Etsu Chemical Co., Ltd.) was vulcanized and cured to form a fluorocarbon siloxane rubber having a film thickness of 50 μm.

Heating and Pressurizing

Temperature of heating roller: 140° C.

Nip pressure: 130 N/cm$^2$

Cooling Step

Cooler: heat sink length of 80 mm

Speed: 53 mm/sec

Temperature: 50° C.

Example 4

Except for using the belt curl controlling device shown in FIG. 9, the image forming was performed in the same way as example 1. The curved shape (polarity, curvature radius, curved length) of the electrophotographic print in the curl controlling was controlled as shown in Table 4.

Comparative Example 1

Except for using the belt curl controlling device shown in FIG. 10, the image forming was performed in the same way as example 1. The curved shape (polarity, curvature radius, curved length) of the electrophotographic print in the curl controlling was controlled as shown in Table 4.

Comparative Example 2

Except for using the belt curl controlling device shown in FIG. 11, the image forming is performed in the same way as example 1. The curved shape (polarity, curvature radius, curved length) of the electrophotographic print in the curl controlling is controlled as shown in Table 4.

TABLE 4

| | Glass transition temperature (Tg) | | | | | | Image-receiving |
|---|---|---|---|---|---|---|---|
| | Image-receiving | Toner | Curl controlling means Curved shape | | | | sheet temperature |
| | layer binder (° C.) | binder (° C.) | Shape number | Polarity | Curvature radius | Curved length | (*) (° C.) |
| Example 1 | 74.9 | 53 | FIG. 5 | + | 20 mm | 20 mm | 80-73 |
| Example 2 | 74.9 | 53 | FIG. 7 | + | 25 mm | 30 mm | 80-72 |
| Example 3 | 74.9 | 53 | FIG. 8 | + | 25 mm | 30 mm | 80-70 |
| Example 4 | 74.9 | 53 | FIG. 9 | + | 40 mm | 40 mm | 78-69 |
| Comparative Example 1 | 74.9 | 53 | FIG. 10 | nil | 0 | 0 | — |
| Comparative Example 2 | 74.9 | 53 | FIG. 11 | nil | 0 | 0 | — |

*Polarity: Plus when the surface of the image-receiving layer was in the direction of a convex shape, and minus when the surface of the image-receiving layer was in the direction of a concave shape

*Image-receiving sheet temperature: the thermocouple thermometer as measuring equipment (detecting part: copper constantan (diameter 0.3 mm), measuring part: NR-1000 manufactured by Keyence Corporation) was stuck on the surface of the electrophotographic print, and a temperature of the image-receiving sheet in the entrance part (C in FIG. 2) and exit part (D in FIG. 2) in the position of the curl controlling member was measured.

Example 2

Except for using the belt curl controlling device shown in FIG. 7, the image forming was performed in the same way as example 1. The curved shape (polarity, curvature radius, curved length) of the electrophotographic print in the curl controlling was controlled as shown in Table 4.

Example 3

Except for using the belt curl controlling device shown in FIG. 8, the image forming was performed in the same way as example 1. The curved shape (polarity, curvature radius, curved length) of the electrophotographic print in the curl controlling was controlled as shown in Table 4.

<Measuring Method of Curl Amount>

The obtained electrophotographic print was placed on a horizontal base, in which the curled convex surface thereof was facing to the base and the average value of the height of the four corners was measured. When the convex surface was an image-forming surface, it was shown as + (plus), and when the convex surface was a non-image-forming surface, it was shown as − (minus). The results are shown in Table 5.

The measured sample was changed from roll diameter of 120 mm to 40 mm at a 10 mm interval, and the highest density black solid image was output with every 10 pieces at each roll paper diameter (9 spots). As a result, the maximum value of the measured value was the curl amount for 10 pieces×9 spots=90 pieces.

The following sensory evaluation, for the actual image sample, was shown as the average value of evaluation by the 20 people who were comparatively skilled at evaluation of image quality of photographs. The results are shown in Table 5. The measured sample was the same as the above-mentioned curl amount measuring method.

<Sensory Quality (Curl Property)>

5: extremely good and equivalent to or higher than silver halide photographs

4: equivalent to silver halide photographs and the print gives a natural feeling as a photograph 3: different from silver halide photographs but is acceptable as a photograph to some extent 2: significantly inferior to silver halide photographs and is not acceptable as a photograph 1: not acceptable at all as a print

TABLE 5

| | Evaluation result | |
|---|---|---|
| | Curl amount (mm) | Sensory quality (curl property) |
| Example 1 | +5 | 4 |
| Example 2 | +3 | 4 |
| Example 3 | +3 | 4 |
| Example 4 | +4 | 4 |
| Comparative Example 1 | −15 | 2 |
| Comparative Example 2 | −13 | 2 |

According to the image-recording process and an image-recording apparatus of the present invention, even at high density image and high speed image output, it can be achieved to suppress the occurrence of curl in the final image sheet, and control the desired direction and size of the curl, and can be used widely in any one of various types of image-recording materials selected from an electrophotographic material, a heat sensitive material, a sublimation transfer material, a heat-transfer material, a silver halide photograph material, and an ink-jet recording material.

What is claimed is:

1. An image-recording process comprising:

recording an image on an image-recording material which comprises a thermoplastic resin contained layer on a support;

heating the image-recording material to a temperature higher than a glass transition temperature of a thermoplastic resin in the thermoplastic resin contained layer;

controlling a curl by contacting a curl controlling member with at least a part of the image-recording material; and cooling the image-recording material to a temperature below a glass transition temperature of the thermoplastic resin, wherein the curl controlling and cooling are carried out side by side and the temperature of the image-recording material shifts below the glass transition temperature of the thermoplastic resin during the curl controlling.

2. The image-recording process according to claim 1, wherein the thermoplastic resin contained layer is at least any one selected from an image-receiving layer, a color material layer, an intermediate layer, a support, a backing layer, and a combination thereof.

3. The image-recording process according to claim 1, wherein a glass transition temperature of the thermoplastic resin is 40° C. to 100° C.

4. The image-recording process according to claim 1, wherein the curl controlling member is contacted with the image-recording material at a temperature ±10° C. of a glass transition temperature of the thermoplastic resin.

5. The image-recording process according to claim 1, wherein at least any one of a direction of the curl and a size of the curl is controlled.

6. The image-recording process according to claim 1, wherein the curl controlling member comprises a curved shape on its surface, and the curl is controlled by changing at least any one of a curvature radius and a curved length of the curved shape.

7. The image-recording process according to claim 1, wherein the support comprises a raw paper and a polyolefin resin layer disposed on at least one surface of the raw paper.

8. The image-recording process according to claim 1, wherein the image-recording material is in roll configuration.

9. The image-recording process according to claim 1, wherein the image-recording material is selected from any one of an electrophotographic material, a heat-sensitive material, a sublimation-transfer material, a heat-transfer material, a silver halide photograph material, and an ink-jet recording material.

10. The image-recording process according to claim 9, wherein the image-recording material is the electrophotographic material comprising a support, and at least a toner image-receiving layer and a toner disposed on the support.

11. An image-recording apparatus comprising:

a support;

an image-recording unit recording an image on an image-recording material comprising a thermoplastic resin contained layer on the support;

a heating unit heating the image-recording material to a temperature higher than a glass transition temperature of a thermoplastic resin in the thermoplastic resin contained layer;

a curl controlling unit controlling a curl by contacting a curl controlling member with at least a part of the image-recording material; and a cooling unit cooling the image-recording material to a temperature below a glass transition temperature of the thermoplastic resin, wherein the curl controlling unit is arranged to shift the temperature of the image-recording material below the glass transition temperature of the thermoplastic resin during the period when a curl controlling member is in contact with at least a part of the image-recording material.

12. The image-recording apparatus according to claim 11, wherein the thermoplastic resin contained layer is at least any one selected from an image-receiving layer, a color material layer, an intermediate layer, a support, a backing layer, and a combination thereof.

13. The image-recording apparatus according to claim 11, wherein the curl controlling member is contacted with the image-recording material at a temperature ±10° C. of a glass transition temperature of the thermoplastic resin.

14. The image-recording apparatus according to claim 11, wherein at least any one of a direction of the curl and a size of the curl is controlled.

15. The image-recording apparatus according to claim 11, wherein the curl controlling member comprises a curved shape on its surface, and the curl is controlled by changing at least any one of a curvature radius and a curved length of the curved shape.

16. The image-recording apparatus according to claim 11, wherein the curl controlling unit comprises any one of an image fixing member and the curl controlling member.

17. The image-recording apparatus according to claim 11, wherein the curl controlling unit comprises a belt curl controlling device.

18. The image-recording apparatus according to claim 17, wherein the belt curl controlling device comprising:

a first endless belt part comprising a first heating roller and a first tension roller, and a first endless belt which is spanned rotatably over the first heating roller and the first tension roller; and a second endless belt part comprising a second heating roller and a second tension roller, and a second endless belt which is spanned rotatably over the second heating roller and the second tension roller; and an intersection angle between a line perpendicular to the line that connects the rotation axes of the first and the second tension rollers and a direction line that image-recording material travels to the first and the second tension rollers is 1° to 20°.

19. The image-recording apparatus according to claim 18, wherein a curved shape of a curl controlling member formed from the first endless belt part and second endless belt part is able to be controlled by changing at least any one of front and back positional relation and up and down positional relation of the first tension roller and the second tension roller.

20. The image-recording apparatus according to claim 17, wherein the belt curl controlling device comprises:

a first endless belt part comprising a first heating roller and a first tension roller, and a first endless belt which is spanned rotatably over the first heating roller and the first tension roller; and a second endless belt part comprising a second heating roller and a second tension roller, and the second endless belt which is spanned rotatably over the second heating roller and the second tension roller; and a curl controlling member, wherein the first heating roller and the second heating roller are arranged so as to be possibly contacted with the image-recording material through each endless belt.

21. The image-recording apparatus according to claim 20, wherein the curl controlling member is arranged in an inside of at least any one of the first endless belt part and the second endless belt part so as to contact an inner surface of the endless belt.

22. The image-recording apparatus according to claim 20, wherein the curl controlling member is arranged in an outside of the first endless belt part and the second endless belt part, and in a direction of the image-recording material being discharged.

23. The image-recording apparatus according to claim 11, wherein the curl controlling member is a guide roller capable of controlling a position contacting the image-recording material.

24. The image-recording apparatus according to claim 11, wherein the curl controlling member comprises a cooling function.

* * * * *